US005564919A

United States Patent [19]

Tsai

[11] Patent Number: 5,564,919

[45] Date of Patent: Oct. 15, 1996

[54] PORTABLE BURNING DEVICE

[76] Inventor: Chin-Lin Tsai, 3F, No. 94, Sec. 4, Chung Hsin Rd., San Chung City, Taipei Hsien, Taiwan

[21] Appl. No.: 568,670

[22] Filed: Dec. 7, 1995

[51] Int. Cl.[6] ..... F23Q 7/12

[52] U.S. Cl. ..... 431/255; 431/344

[58] Field of Search ..... 431/255

[56] References Cited

U.S. PATENT DOCUMENTS

| | | | |
|---|---|---|---|
| 4,597,732 | 7/1986 | Yoshinaga | 431/255 |
| 4,952,138 | 8/1990 | Ho | 431/255 |
| 5,466,149 | 11/1995 | Tsai | 431/255 |

*Primary Examiner*—Carroll B. Dority
*Attorney, Agent, or Firm*—Bucknam and Archer

[57] ABSTRACT

The portable burning device includes a gas tank, a coupling seat, a piezo-electric means, a control means, a gas release means, an outer tube unit and a shell. In use, a knob is turned in a counter-clockwise direction to cause a projection of an adjusting rod to retreat so as to be separated from a neck hole of a shaft such that fuel gas may be induced via an intake tube into a gas duct. The pressure of the fuel gas is regulated by a pressure regulating means to accelerate flow of the fuel gas into a shaft hole. The fuel gas then passes through the neck hole and a shaft opening and is ejected via a gas nozzle. The current of gas thus generated draws in ambient air via an air vent into a mixing tube. The mixture of gas and air flows through a gear seat and is ejected via a central gear hole and a plurality of gear ducts defined between adjacent teeth of a gear. By pressing a push button at this point, electrostatic sparks generated by the piezo-electric means will ignite the mixture.

10 Claims, 5 Drawing Sheets

A - A

PORTABLE BURNING DEVICE

BACKGROUND OF THE INVENTION (a) Field of the Invention

The present invention relates generally to a burning device, and more particularly to a portable burning device.

(b) Description of the Prior Art

Containerized liquid gas plays an important role in the design of burning devices because of its facility and convenience. There are various types of burning devices using liquid gas as the source of fuel. In U.S. Pat. No. 08/382,628 to the inventor of the present invention, a gas torch is connected to a gas container which supplies the torch with the necessary fuel. In U.S. Pat. No. 4,804,324 to Prince Industrial Development Co., Ltd., gas supplied from a gas container is vaporized before it is used by a burning device. Besides, U.S. Pat. No. 5,082,440 and U.K. Patent No. 08/203,334 (the latter issued to the inventor of the present invention), a conventional lighter is used as a fuel source for a gas torch.

SUMMARY OF THE INVENTION

A primary object of the present invention is to provide a portable burning device for enhancing the burning efficiency.

Another object of the present invention is to provide a portable burning device which is safe and convenient to operate.

DETAILED DESCRIPTION OF THE PREFERRED EMBODIMENT

Figures 1A, 1B:
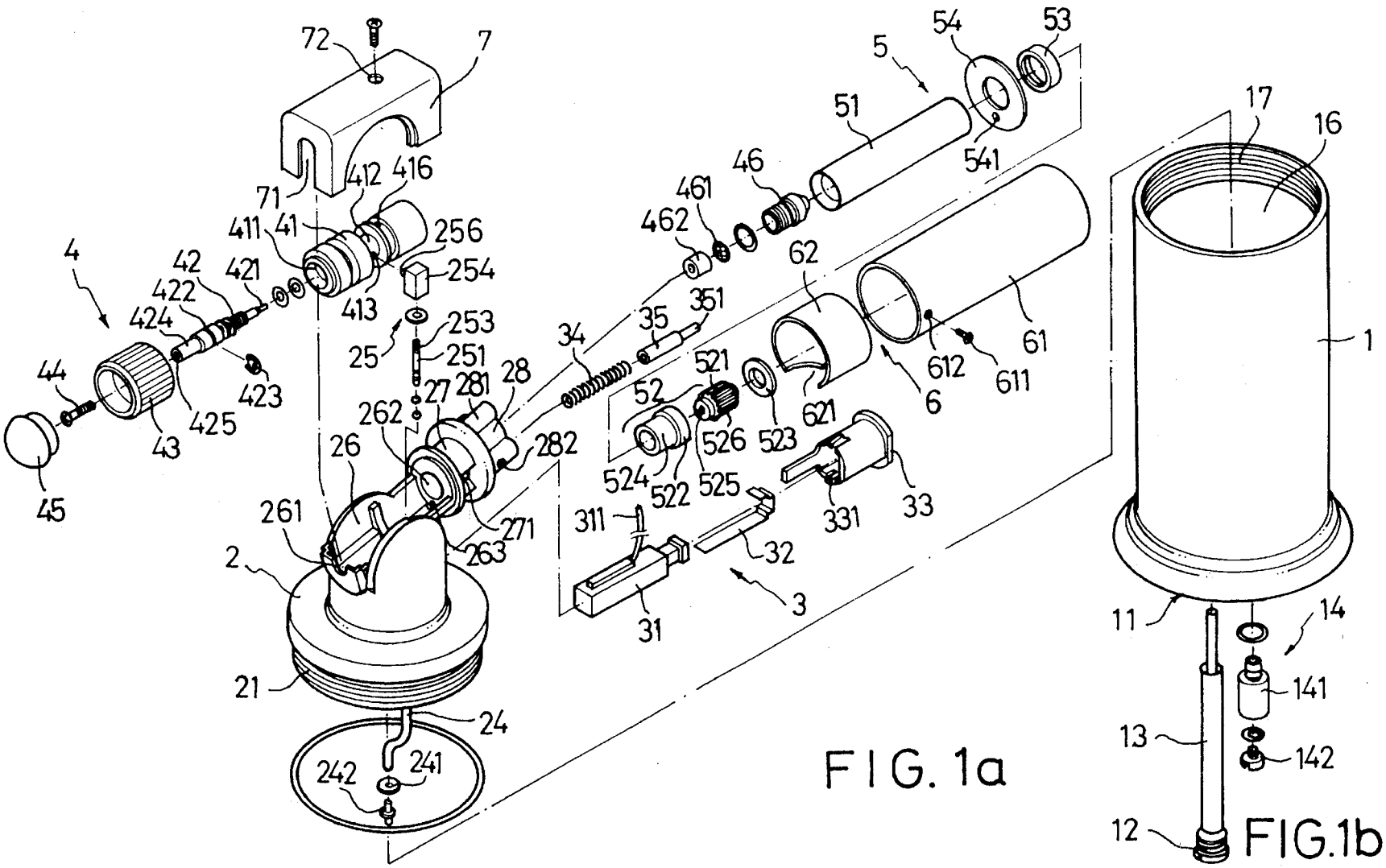
FIG. 1*a* is a perspective exploded view of a preferred embodiment of the burning device of the present invention.
FIG. 1*b* is a perspective exploded view of the gas tank with nozzle 12, gas intake tube 13, valve 141 and screw 142.

With reference to FIG. 1, a preferred embodiment of the burning device according to the present invention essentially comprises a gas tank 1, a coupling seat 2, a piezo-electric means 3, a control means 4, a gas releasing means 5, an outer outer unit 6 and a shell 7.

Figure 4:
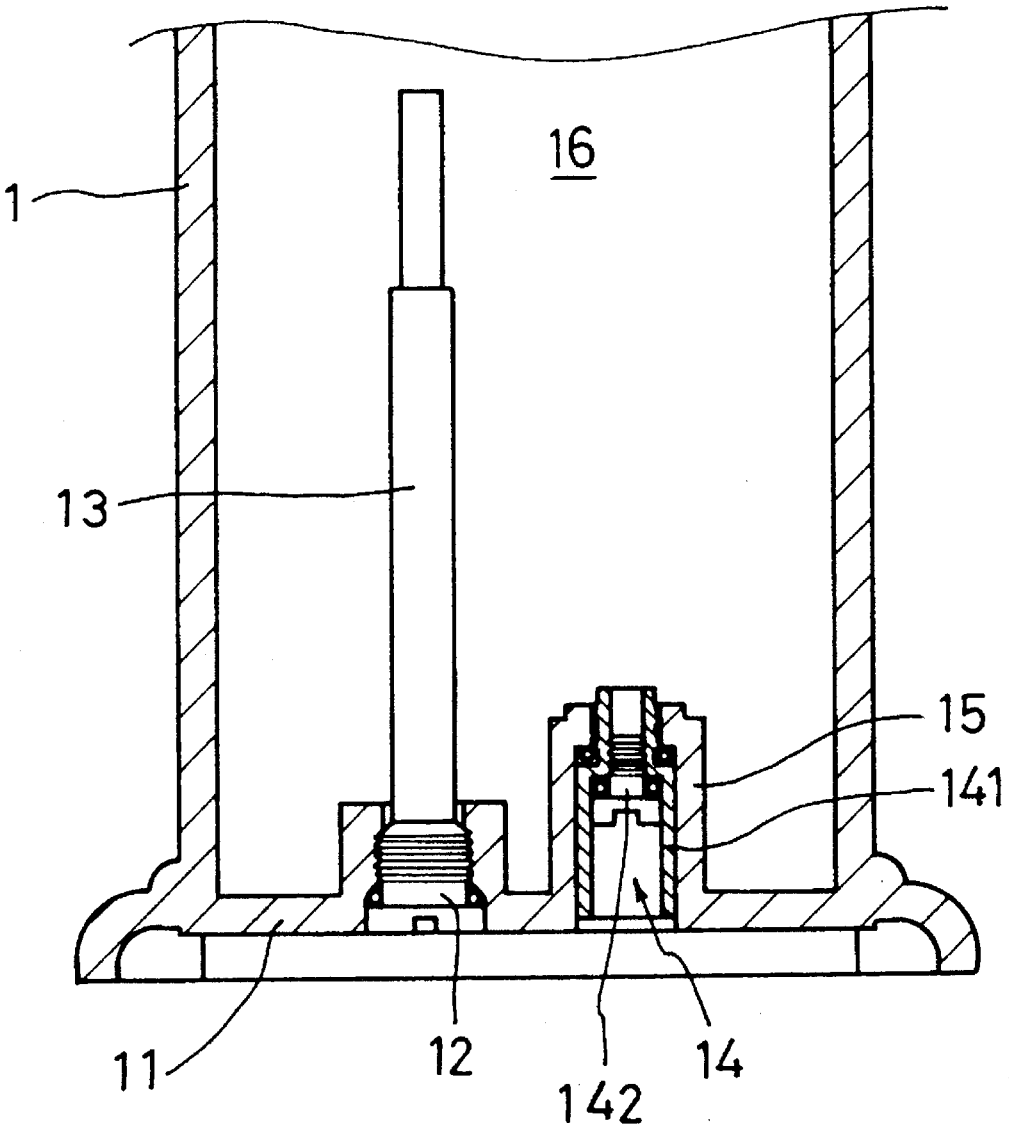
FIG. 4 is a sectional view of a base of a gas tank according to the present invention.

Referring to FIGS. 1 and 4, the gas tank 1 is a hollow cylindrical structure provided with a conventional nozzle 12 and an gas intake tube 13 at a base 11 thereof. Unlike the prior art, a gas escape means 14 is provided at one side of the nozzle 12. The gas escape means 14 consists of a column 15 projecting upwardly from the base 11 into the interior of gas tank 1. The column 15 is internally coupled and locked with a valve 141 by means of a screw 142. Once the valve 141 and the column 15 are properly locked, fuel gas may not leak therefrom. Before delivery, in order to ensure that gas filled into the gas tank 1 during quality control testing will not remain in the gas tank 1 to cause possible gas explosion during transportation, the screw 142 may be disengaged to allow the gas inside the tank to escape and be vaporized. The screw 142 may thereafter be mounted back in place to lock the valve 141 with the column 15. Besides, the gas tank 1 has a hollow interior chamber 18 for containing liquid gas and a threaded hole 17 at an upper portion thereof for coupling with the coupling seat 2.

Figure 2:
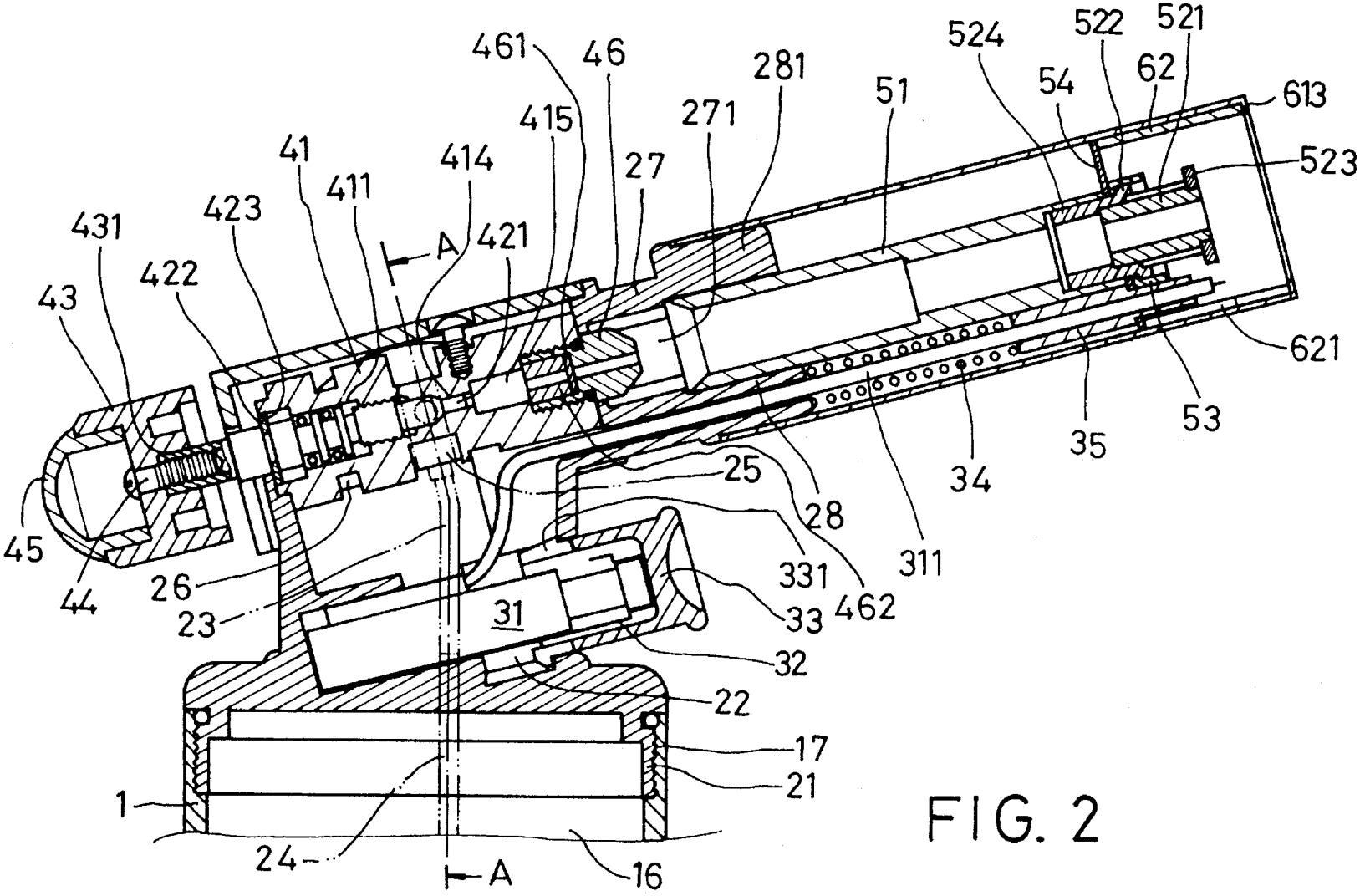
FIG. 2 is a sectional view of a coupling seat, a control means and a gas release means according to the present invention.
Figure 3:
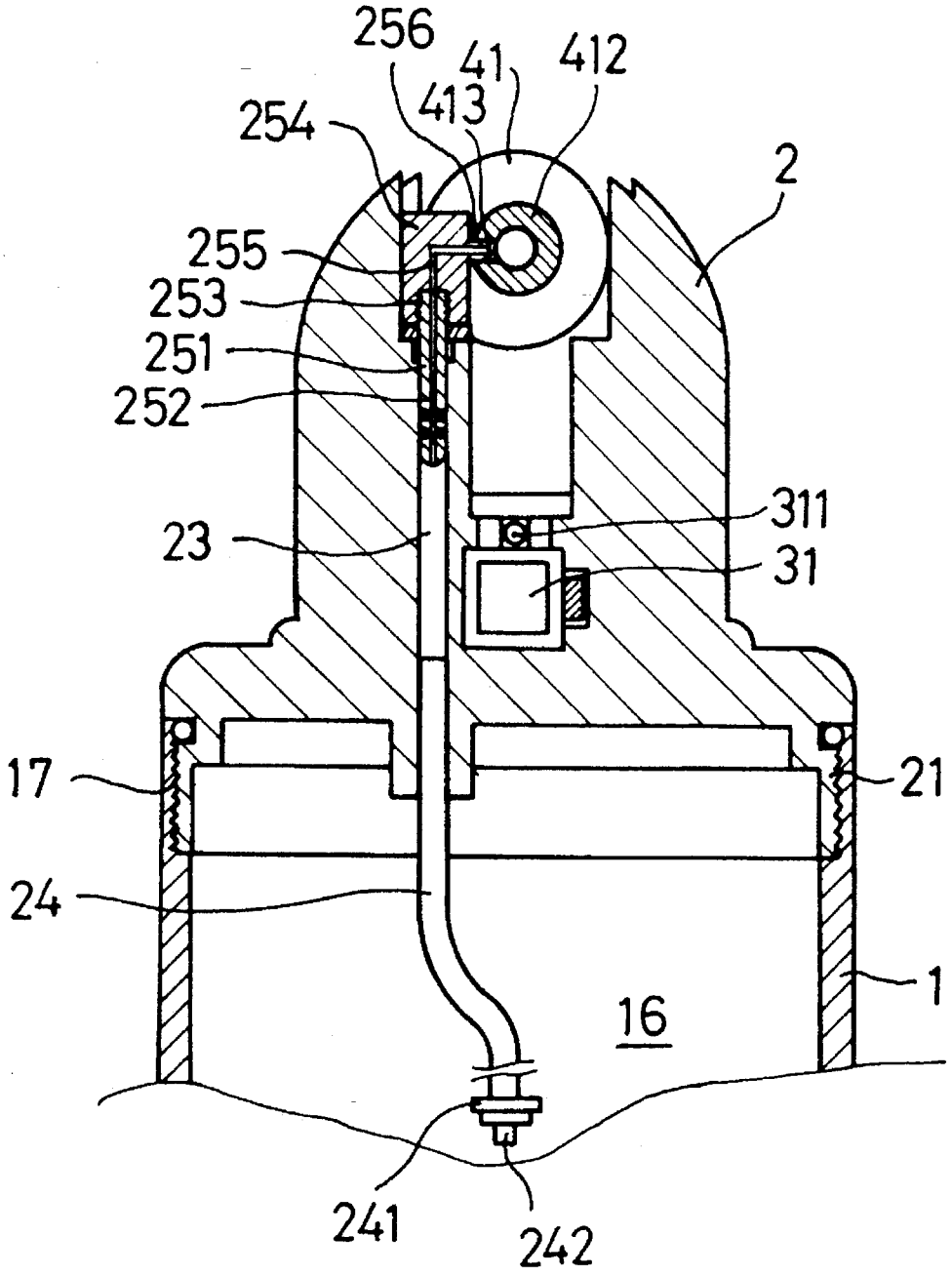
FIG. 3 is a sectional view of FIG. 2, taken along line A—A.

With reference to FIGS. 1 and 2, the coupling seat 2 is a structure with a circular base and an inclined body sloping upwardly. The coupling seat 2 has a threaded portion 21 for engaging the threaded hole 17 of the gas tank 1. An inclined chamber 22 slopes upwardly from the circular base of the coupling seat 2 for accommodating the piezo-electric means 3. With reference to FIG. 3, the interior of the coupling seat 2 is provided with a longitudinal gas duct 23 having a lower end thereof connected to the intake tube 24 which has a bend at a lower portion thereof. The intake tube 24 in turn has a lower end thereof fitted with a packing ring 241 and a suction nozzle 242 for accelerating the vaporization of liquid gas. An upper end of the gas duct 23 is insertably connected to the pressure regulating means 25 via a gas post 251. The gas post 251 is provided with a duct 252 of a smaller diameter in the center thereof with threads 253 formed at an upper end thereof for coupling with a pressure regulating seat 254. The pressure regulating seat 254 is internally provided with a bent duct 255 having a right-angled bend and a diameter equivalent to that of the duct 252 and a pin 256 on an outer side thereof for coupling with the control means 4. Since the gas duct 23 has a diameter greater than those of the duct 252 and the bent duct 255, when the fuel gas passes through a narrower path, it will flow past through the narrower path with a greater speed and achieve a more uniform pressure in accordance with Bernoulli's theorem.

Referring to FIGS. 1 and 2 again, a concavity formed in an upper portion of the coupling seat 2 is a recess 26 for the pressure control means 4 to be mounted thereon and positioned. The recess 26 has an arc 261 provided at a rear end thereof with a hole 262 of a comparatively larger diameter formed in an upper end thereof for accommodating a gas nozzle 46 of the control means 4. The recess 26 further has a through hole 263 formed at a lower portion thereof for passage of a lead wire 311 of the piezo-electric means 3. In addition, the coupling seat 2 has a neck portion 27 at an upper portion thereof which is provided with a horizontally oriented air vent 271 for entrance of ambient air into the hole 262 to promote combustion. An extended post 28 is further provided at the recess 26 adjacent the neck portion 27. The extended post 28 has a plurality of curved ribs 281 projecting outwardly therefrom for coupling with an outer tube 62 of the outer tube unit 6, with one of the ribs 281 provided with a rib hole 282 for passage of a screw which locks the outer tube 61 thereonto.

The piezo-electric means 3 consists of a conventional piezo-electric element 31 joined to a conductive strip 32, both of which are accommodated in the inclined chamber 22. A push button element 33 is fitted onto the inclined chamber 22 with two hooks 331 engaging an inner wall of the inclined chamber 22 to prevent the push button element 33 from slipping out. The lead wire 311 above the piezo-electric element 31 passes through the above-mentioned through hole 263 and extends to near a fire nozzle 52. Besides, in order to position the lead wire 311 to ensure that electrostatic sparks generated thereby may directly contact the fire nozzle 52, the lead wire 311 is fitted with a spring 34 after it passes through the through hole 263 and is then further led through an insulated tube 35 which has an end 351 insertably connected with the gas release means 5.

The control means 4 consists of a hollow cylindrical shaft 41 situated in the recess 26. The shaft 41 has a longitudinal shaft hole 411 and a neck portion 412 for receiving and positioning the pressure regulating seat 254. The neck portion 412 is provided with a horizontally oriented vent 413 for insertion of the pin 256 of the pressure regulating seat 254 to allow the fuel gas to enter directly into the shaft hole 411. A vertical hole 416 is formed above the vent 413 passage of a screw which locks the shell 7 onto the shaft 41. In addition, a threaded adjusting rod 42 is caused to pass through a rear end of the shaft hole 411 to be engaged therewith. When the adjusting rod 42 is turned, it may reciprocate inside the shaft hole 411, causing a projection 421 at a front end thereof to close or open a neck hole 414 at a front end of the neck portion 412 to allow or stop the passage of fuel gas. The adjusting rod 42 is further provided with a groove 422 at a middle section thereof for receiving a C-clip 423, which urges against the arc 261 of the recess 26 so as to limit the backward displacement of the adjusting rod 42. Furthermore, the adjusting rod 42 has a post 424 at a rear end thereof which is provided with a screw hole 425. After the post 424 is inserted an opening 431 of a knob 43, a screw 44 may be driven through the opening 431 into the screw hole 425 to lock them together. When the knob 43 is turned, the adjusting rod 42 is caused to synchronously turn therewith, controlling the opening or closing of the neck hole 414. The knob 43 may further be provided with a decorative cap 45 or concealing the screw 44.

When the fuel gas passes through the shaft hole 411 and the neck hole 414, it follows a predetermined path to flow out of a shaft opening 415 at a front end of the shaft 41, and the shaft opening 415 is internally coupled with the gas nozzle 46 so that the fuel gas may be ejected via the gas nozzle 46. The gas nozzle 45 contains a screw 461 and a positioning tube 462 for filtering impurities in the fuel gas to prevent possible clogging of the gas nozzle 46.

The gas release means 5 consists of a mixing tube 51 having one end thereof connected to hole 262 of the recess 26 so that, when the fuel gas is ejected from the gas nozzle 46, the current of gas thus generated will draw the ambient air into the mixing tube 51 via the air vent 271, and the mixture of gas and air will be ejected via fire nozzle 52 at the other end. The fire nozzle 52 consists of a gear 521 and a gear seat 522 coupled together. The gear 521 is fitted with a baffle ring 523, and the gear seat 522 has a stem 524 at a rear end thereof for passing through a ring 53 and a positioning piece 54 to be coupled with the mixing tube 51, so that the mixture may pass through the gear sat 522 to be ejected through a central gear hole 525 and a plurality of gear ducts 526 defined between adjacent teeth of the gear 521. Since the gear 521 is externally fitted with the ring 523, the mixture will be caused to advance along the gear ducts 526 in the direction of the baffle ring 523 where the mixture will be stopped. If the piezo-electric means 3 is pressed at this point, the electrostatic sparks thus generated will ignite the mixture of gas and air at the baffle ring 523 to the front of the fire nozzle 52 and that flowing out along the gear ducts 526.

Furthermore, the positioning piece 54 is provided with a positioning hole 541 for receiving and positioning the end 351 of the insulated tube 35. The positioning piece 54 is gripped between the mixing tube 51 and the gear seat 522 so that it may firmly couple with the mixing tube 51.

The outer tube unit 6 consists of the hollow outer tube 61 which has one end thereof fitted with one of the above-mentioned curved ribs 281. A screw 611 is passed through a screw hole 612 formed in the outer tube 61 and the rib hole 282 to join the outer tube 61 and the curved rib 281 together, with their interior space accommodating parts of the gas release means 5 and the piezo-electric means 3.

In order that the gas release means 5 will not slip out of the outer tube 61, the outer tube 61 has a front rim thereof bending inwardly to form a loop-shaped stop element 613, and an elastic ring 62 having a Y-shaped slot 621 is disposed intermediate the stop element 613 and the positioning piece 54.

The shell 7 is sized and shaped to corresponding to the recess 26 so that they may fit together. The shell 7 has a shell slot 71 formed in a position matching that of the arc 261 so that the shell slot 71 and the arc 261 together define a substantially circular space therebetween for projection of post 424 of the adjusting rod 42 therethrough. The shell 7 is further provided with a shell hole 72 for matching the vertical hole 416 of the shaft 41 so that the shell 7 and the shaft 41 may be joined by screws so as to conceal the shaft 41.

Figure 5:
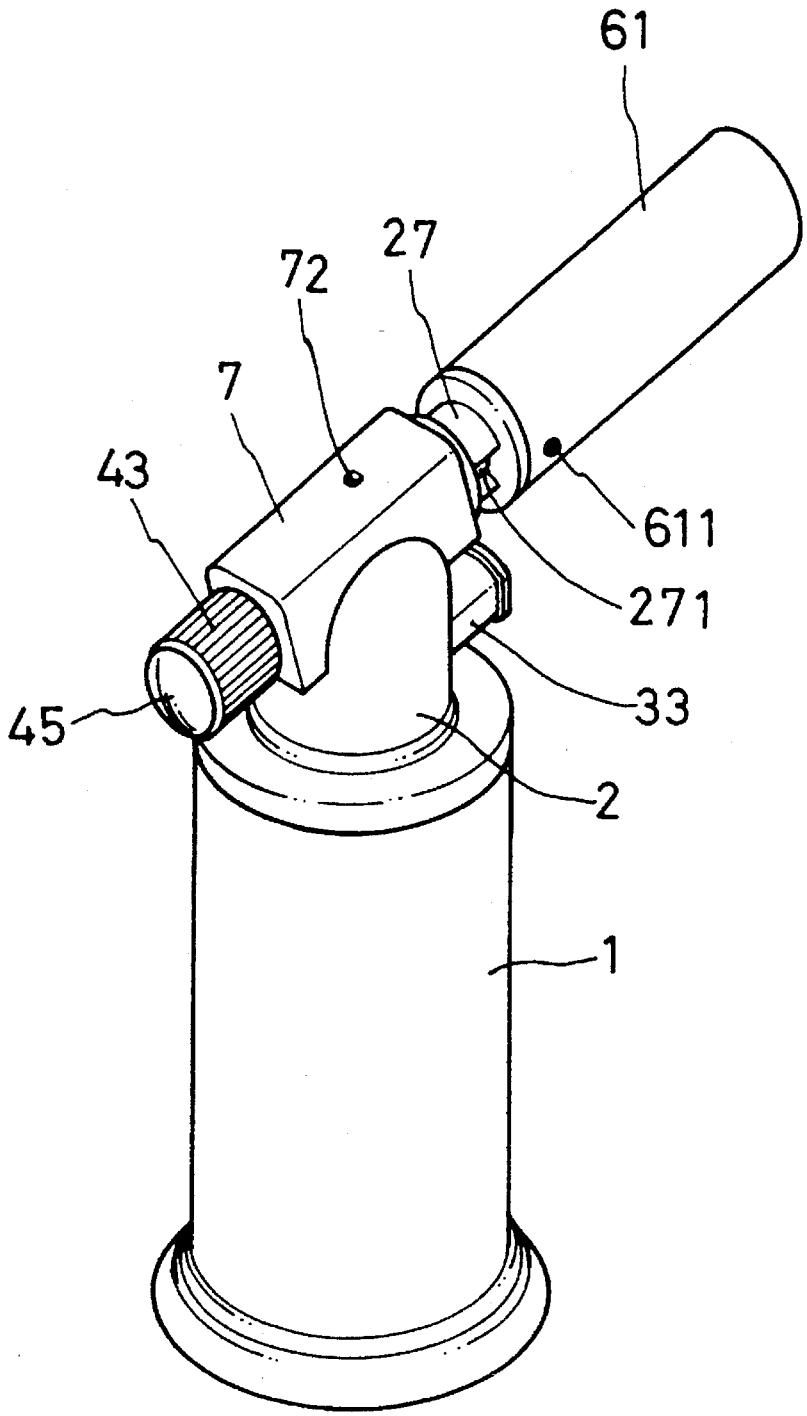
FIG. 5 is a perspective view of the burning device of the present invention in an assembled state.

Referring to FIG. 5, it shows a burning device of the present invention in an assembled state. IN use, the knob 43 is turned in a counter-clockwise direction so that the projection 421 of the adjusting rod 42 retreats rearwardly and separates from the neck hole 414. At this time, the fuel gas enters via the intake tube 24 into the gas duct 23 and its pressure is regulated by the pressure regulating means to a suitable and stable one. The fuel gas then speedily flows into the shaft hole 411 past the neck hole 414 and the shaft opening 415 to be ejected via the gas nozzle 46. The current of gas thus generated draws ambient air into the mixing tube 51 via the air vent 271, and the mixture of gas and air flows through the hear seat 522 and out through the central gear hole 525 and the gear ducts 526 around the periphery of the gear 521. By pressing the push button 33 at this point, the piezo-electric means 3 will generate sparks to ignite the mixture.

To adjust the intensity of the flame, it is only necessary to turn the knob 43. When the C-clip 423 urges against the arc 261 of the recess 26, a maximum amount of fuel will be ejected.

When the burning device of the present invention is not in use, the knob 43 is turned clockwisely so that the projection 421 of the adjusting rod 42 seals the neck hole 414 to stop the flow of fuel gas into the gas release means 5, and the flame will automatically extinguish.

In actual practice, the advantages achieved by the burning device of the present invention include the following:

1. The provision of the gas escape means ensures that no residual gas is inside the tank so to prevent avoid possible explosion during transportation.
2. The inclined configuration of the upper portion of the coupling seat and the parallel arrangement of the piezo-electric means faciliate manipulation and permit single-handed operation.
3. The provision of the pressure regulating means ensures that the pressure of the fuel gas is uniform and stable so that the flame may burn stably to prevent sudden eruption of large flames.
4. The control or regulation of the gas flow is made convenient by the turning of the knob.
5. The flame intensity is concentrated. Since the mixture of gas and air is ejected via the central gear hole, the flame is concentrated and hence speeds up the welding operation.
6. Even if the flame at the central gear hole is blown off, the current of fuel gas and air flowing along the gear ducts around the periphery of the gear may maintain the flame so that it is not necessary to start the fire again.

Although the present invention has been illustrated and described with reference to the preferred embodiment thereof, it should be understood that it is in no way limited to the details of such embodiment but is capable of numerous modifications within the scope of the appended claims.

What is claimed is:

1. A portable burning device comprising:

a gas tank being a hollow cylindrical structure for containing liquid gas and having a base provided with a gas filling means and a gas escape means and having a threaded portion at an upper part thereof;

a coupling seat consisting of a circular base and an upwardly inclining structure, said coupling seat having a threaded portion at a lower part thereof for coupling with said threaded portion of said gas tank, and an inclined chamber for accommodating a piezo-electric means; said coupling seat being internally provided with a vertical gas duct having a lower portion thereof connected to an intake tube unit while an upper portion thereof joined to a pressure regulating means, said pressure regulating means being in turn associated with a control means to form a gas path, said coupling seat further having a depression at an upper surface thereof for defining a recess for accommodating and positioning said control means, said recess being provided with a horizontal hole and a through hole at a front portion thereof for respectively receiving a gas nozzle and passage of a lead wire, a neck portion of said coupling seat being provided with an air vent at a position corresponding to that of said gas nozzle and an extended post for coupling with an outer tube;

said piezo-electric means consisting of a piezo-electric element, a conductive strip and a push button disposed respectively into said inclined chamber, said push button having two hooks for engaging an inner wall of said inclined chamber, and said lead wire located above said piezo-electric element passing through said through hole of said recess and extending to a fire nozzle;

said control means consisting of a hollow cylindrical shaft insertably connected with said recess, said shaft being provided with a shaft hole, a neck hole and a shaft opening disposed-in a stair-like arrangement and communicating with one another for accommodating and coupling with an adjusting rod and said gas nozzle, said adjusting rod having a rear end connected to a knob for synchronous movement therewith, said shaft having a neck portion at a middle section thereof for receiving and positioning said pressure regulating means, said neck portion having a vent in one side thereof to enable said pressure regulating means to communicate with said shaft hole;

a gas release means consisting of a hollow cylindrical mixing tube which has one end thereof receiving fuel gas ejected by said gas nozzle and drawn-in ambient air and coupled to said recess, with the other end thereof coupled to said fire nozzle for ejecting a mixture of fuel gas and air;

said outer tube being a hollow metal tubular structure for locking with an extended post of said coupling seat and shrouding said gas release means and lead wire; and a shell being sized and shaped to match said recess for locking therewith, said shell having a slot formed in a rear end thereof, said slot being joined to an arc of said recess to define a circular hole for projection of said adjusting rod therethrough to faciliate turning of said knob to control the flow of fuel gas.

2. A portable burning device as claimed in claim 1, wherein said gas escape means consists of a column provided on said base and extending upwardly into the hollow of said gas tank, said column being connected to a valve and being locked therewith by means of a screw, said screw being disengageable therefrom to allow any residual gas in said gas tank to escape therefrom.

3. A portable burning device as claimed in claim 1, wherein said pressure regulating means consists of a gas post and a gas duct of a comparatively larger diameter coupled together, said gas post having a threaded portion coupling with a pressure regulating seat such that a duct of a small diameter disposed intermediate said pressure regulating seat and said gas duct communicates with a bent duct of gas pressure regulating seat, and said pressure regulating seat having a pin inserted into said vent in one side of said neck portion of said shaft so that the fuel gas may flow faster and has a more stable pressure.

4. A portable burning device as claimed in claim 1, wherein said lead wire on the outside of said extended post of said coupling seat may be fitted with a spring and may pass through an insulated tube so that electrostatic sparks generated by said lead wire may be oriented towards said fire nozzle.

5. A portable burning device as claimed in claim 1, wherein, during displacement of said adjusting rod within said shaft hole, a projection at a front end of said adjusting rod may close or open said neck hole to allow or stop the flow of fuel gas, and said adjusting rod has a groove formed in a middle section thereof for receiving a C-clip which may urge against an arc of said recess to limit rearward displacement of said adjusting rod.

6. A portable burning device as claimed in claim 1, wherein a screen is disposed inside said gas nozzle with a positioning tube urging thereagainst for filtering impurities in the fuel gas.

7. A portable burning device as claimed in claim 1, wherein said fire nozzle consists of a gear seat and a gear coupled together, and a baffle ring fitted on said gear, said gear seat having a stem at a rear end thereof connected to said mixing tube so that the mixture of fuel gas and air may be ejected via a central gear hole of said gear and a plurality of gear ducts defined between adjacent teeth around a periphery of said gear.

8. A portable burning device as claimed in claim 7, wherein said fire nozzle passes through a ring and a positioning piece before joining said mixing tube, said positioning piece being held between said mixing tube and said gear seat, such that the mixture of fuel gas and air may be checked by said ring to advance in the direction of said baffle ring along said gear ducts and to form a loop-shaped mother flame, and said positioning piece has a hole for receiving and positioning an end of an insulated tube to fix said lead wire.

9. A portable burning device as claimed in claim 1, wherein said outer tube has a front rim bending inwardly to form a loop-shaped stop element and an elastic ring with a Y-shaped slot is fitted onto a positioning piece to prevent said gas release means from slipping from said outer tube.

10. A portable burning device as claimed in claim 1, wherein said intake tube unit consists of an intake tube which has a bend at a lower portion thereof and is coupled with a packing ring and an intake nozzle at a rear end thereof for accelerating vaporization of the fuel gas.

* * * * *